US010008787B2

(12) United States Patent
Kondo et al.

(10) Patent No.: US 10,008,787 B2
(45) Date of Patent: Jun. 26, 2018

(54) CONNECTOR TERMINAL WITH AN IMPEDANCE ADJUSTING MEMBER

(71) Applicant: Hosiden Corporation, Yao (JP)

(72) Inventors: Hayato Kondo, Yao (JP); Masakazu Yamazaki, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days. days.

(21) Appl. No.: 15/814,921

(22) Filed: Nov. 16, 2017

(65) Prior Publication Data

US 2018/0151965 A1 May 31, 2018

(30) Foreign Application Priority Data

Nov. 25, 2016 (JP) ..... 2016-229242

(51) Int. Cl.
*H01R 4/60* (2006.01)
*H01R 4/48* (2006.01)
*H01R 4/18* (2006.01)

(52) U.S. Cl.
CPC ..... *H01R 4/60* (2013.01); *H01R 4/184* (2013.01); *H01R 4/4818* (2013.01)

(58) Field of Classification Search
CPC ..... H01R 4/60; H01R 4/184; H01R 4/4818
USPC ..... 439/884
See application file for complete search history.

(56) References Cited

U.S. PATENT DOCUMENTS 3,711,942 A * 1/1973 Reynolds ..... G01R 31/021 29/407.05
4,772,223 A * 9/1988 Yasumoto ..... H01R 24/44 333/160
2013/0252462 A1* 9/2013 Tang ..... H01R 9/0524 439/578
2015/0295359 A1* 10/2015 Vinther ..... H01R 13/6473 439/578

FOREIGN PATENT DOCUMENTS

JP 5332677 8/2013

* cited by examiner

*Primary Examiner* — Tulsidas C Patel
*Assistant Examiner* — Travis Chambers
(74) *Attorney, Agent, or Firm* — Rankin, Hill & Clark LLP

(57) ABSTRACT

A connector terminal is provided which has a first connecting portion that is tubular, in one side, and a second connecting portion in the other side, which further has a coupling portion that couples between the first and second connecting portions, and that is higher in impedance than the first connecting portion, and in which the trouble of providing impedance matching between the first connecting portion and the coupling portion is reduced. The connector terminal includes an impedance adjusting member that overlaps at least a first side part of the coupling portion. The impedance adjusting member is fixed in a state where one end portion of the impedance adjusting member is inserted into the body portion.

7 Claims, 5 Drawing Sheets

CONNECTOR TERMINAL WITH AN IMPEDANCE ADJUSTING MEMBER

TECHNICAL FIELD

The present invention relates to a connector terminal which has a first connecting portion that is tubular, in one side, and a second connecting portion in the other side, which further has a coupling portion that couples between the first and second connecting portions, and that is higher in impedance than the first connecting portion, and in which impedance matching between the first connecting portion and the coupling portion is provided.

BACKGROUND ART

In high-speed transmission or high-frequency transmission, in order to perform high-quality transmission, it is requested to match impedances also in a connector terminal.

Patent Literature 1 discloses a connector terminal that has a tubular body portion which is to be connected to a counter connector terminal, in one side, and a crimp portion in which a crimp piece to which a cable conductor is to be crimped is disposed, in the other side, and that further has a coupling portion (a portion which is in the crimp portion, and in which the crimp piece is not disposed) which is higher in impedance than the body portion. In a state where one end is inserted into the body portion, and the other end is joined to the crimp portion, the cross-sectional outer shape of the coupling portion is increased by an impedance adjusting member which overlaps the coupling portion, so as to coincide with the cross-sectional outer shape of the body portion, thereby providing impedance matching between the body portion and the coupling portion.

PRIOR ART LITERATURE

Patent Literature

Patent Literature 1: Japanese Patent No. 5,332,677

SUMMARY OF THE INVENTION

Problems to be Solved by the Invention

In the connector terminal disclosed by Patent Literature 1, however, the impedance adjusting member must be coupled to the crimp portion, and therefore it is cumbersome to provide impedance matching between the body portion and the coupling portion.

It is an object of the invention to provide a connector terminal which has a first connecting portion that is tubular, in one side, and a second connecting portion in the other side, which further has a coupling portion that couples between the first and second connecting portions, and that is higher in impedance than the first connecting portion, and in which the trouble of providing impedance matching between the first connecting portion and the coupling portion is reduced.

Means for Solving the Problems (1) The present invention is a connector terminal which has a first connecting portion that is tubular, in one side, and a second connecting portion in another side, and which further has a coupling portion that couples between the first and second connecting portions, and that is higher in impedance than the first connecting portion, wherein the connector terminal comprises an impedance adjusting member which overlaps at least a part of the coupling portion, and the impedance adjusting member is fixed in a state where one end portion of the impedance adjusting member is inserted into the first connecting portion.

According to the connector terminal of (1) above, impedance matching between the first connecting portion and the coupling portion can be provided simply by inserting the one end portion of the impedance adjusting member into the first connecting portion. It is not necessary to couple the impedance adjusting member to the second connecting portion. Therefore, the trouble of providing impedance matching between the first connecting portion and the coupling portion is reduced.

(2) The connector terminal according to (1) above has another future wherein the coupling portion is configured by a strip-like piece which is bent into an L-like shape, has first and second side parts which form sides of the L-like shape, respectively, is connected to the first connecting portion in an end of the first side part, and connected to the second connecting portion in an end of the second side part, and the impedance adjusting member overlaps at least the first side part.

According to the connector terminal of (2) above, the coupling portion is bent into an L-like shape, and therefore the second connecting portion does not interfere with the insertion of the one end portion of the impedance adjusting member into the first connecting portion, so that the insertion can be easily performed.

(3) The connector terminal according to (1) or (2) above has a further feature wherein a tapered tip end is formed in the one end portion of the impedance adjusting member.

According to the connector terminal of (3) above, the tapered tip end is formed in the one end portion of the impedance adjusting member, and therefore, when the one end portion of the impedance adjusting member is to inserted into the first connecting portion, the insertion can be easily performed.

(4) The connector terminal according to any one of (1) to (3) above has a still further feature wherein the one end portion of the impedance adjusting member is thicker than an inner diameter of the first connecting portion, thereby forming the one end portion as a press-fitting part which is inserted into the first connecting portion.

According to the connector terminal of (4) above, the one end portion of the impedance adjusting member can be fixed to the first connecting portion by press-fitting.

Effects of the Invention

According the invention, it is possible to provide a connector terminal which has a first connecting portion that is tubular, in one side, and a second connecting portion in the other side, which further has a coupling portion that couples between the first and second connecting portions, and that is higher in impedance than the first connecting portion, and in which the trouble of providing impedance matching between the first connecting portion and the coupling portion is reduced.

DESCRIPTION OF PREFERRED EMBODIMENTS

Hereinafter, several embodiments of the invention will be described with reference to the drawings.

Embodiment 1

Figure 1:
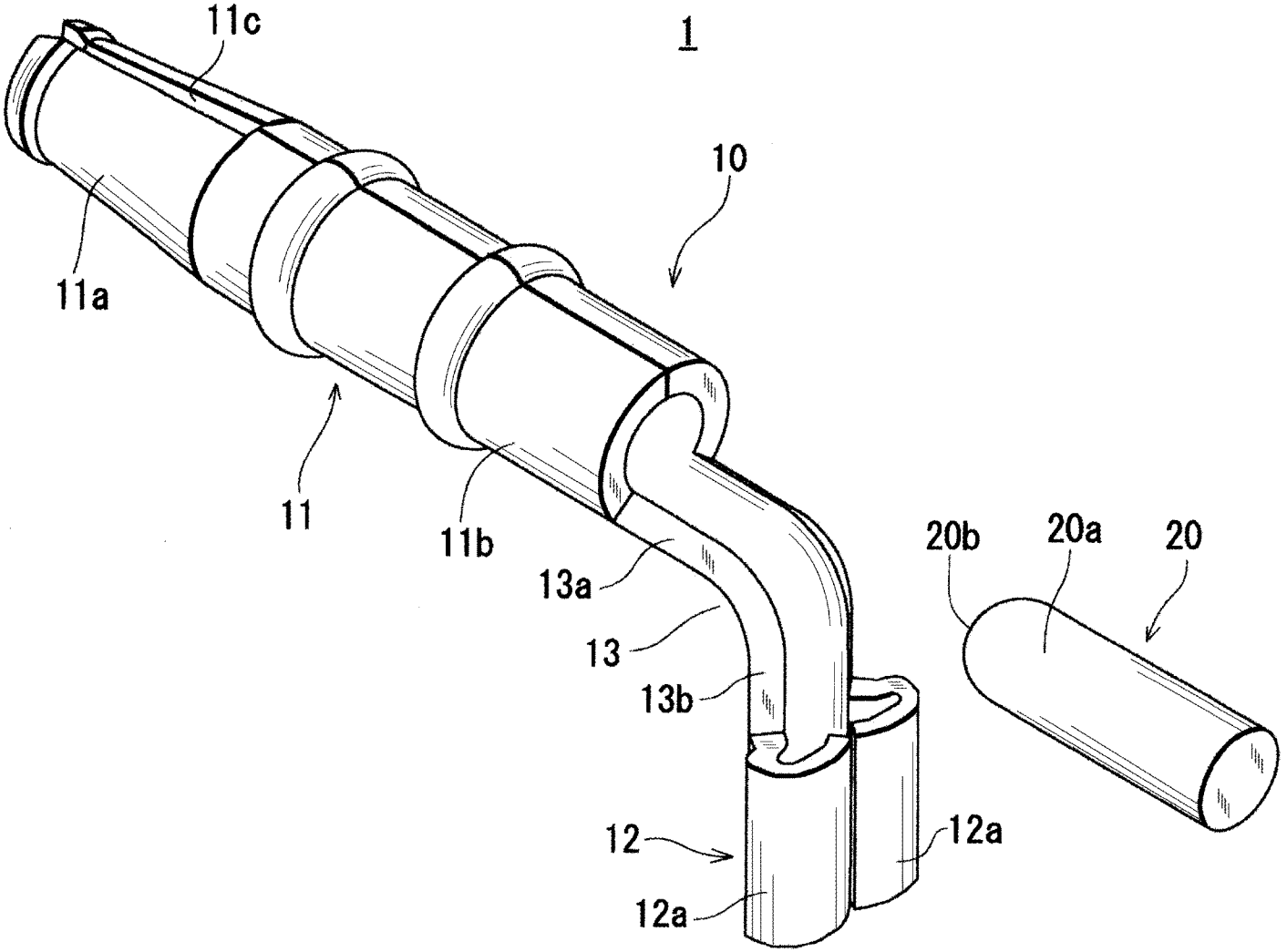
FIG. 1 is an exploded perspective view showing a connector terminal of an embodiment of the invention.
Figure 2:
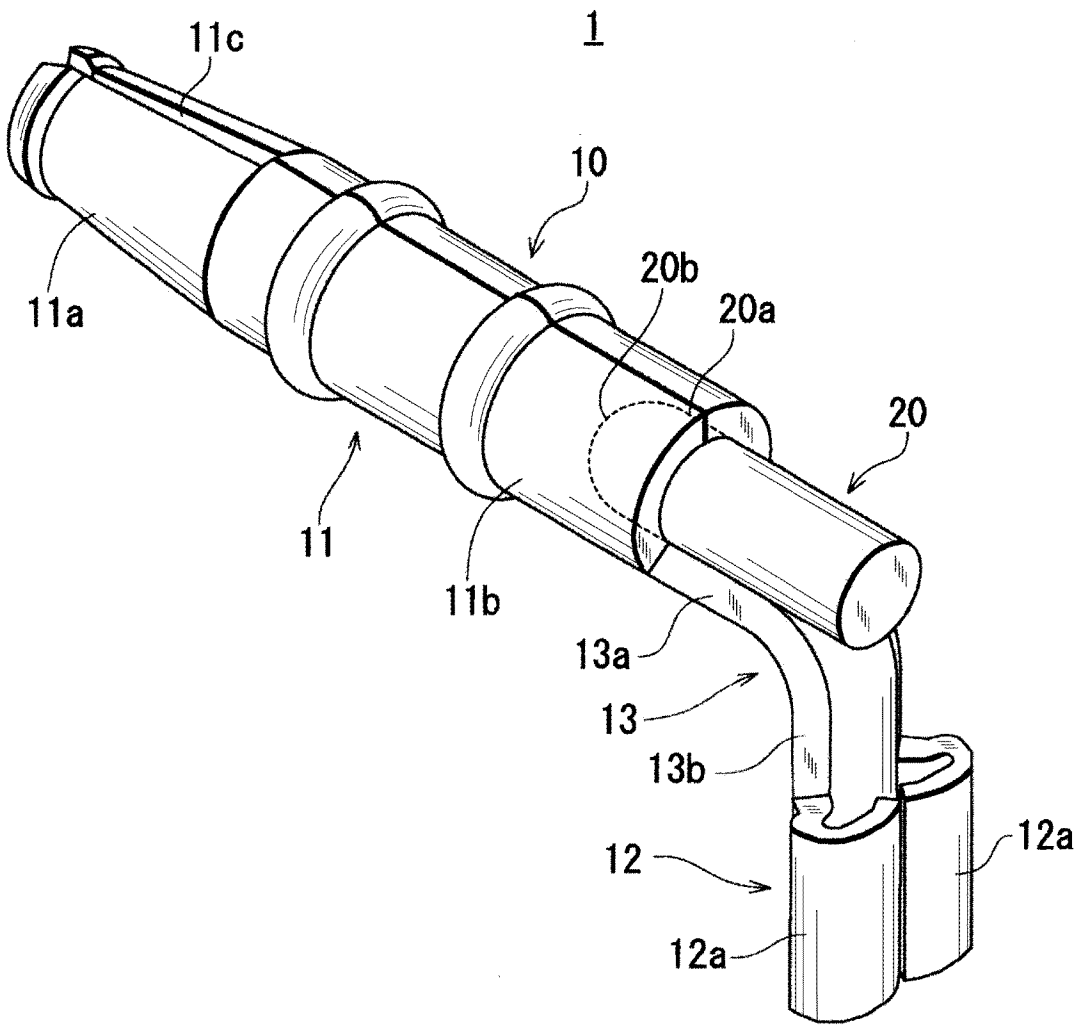
FIG. 2 is a perspective view showing the connector terminal of the embodiment of the invention.
Figure 3:
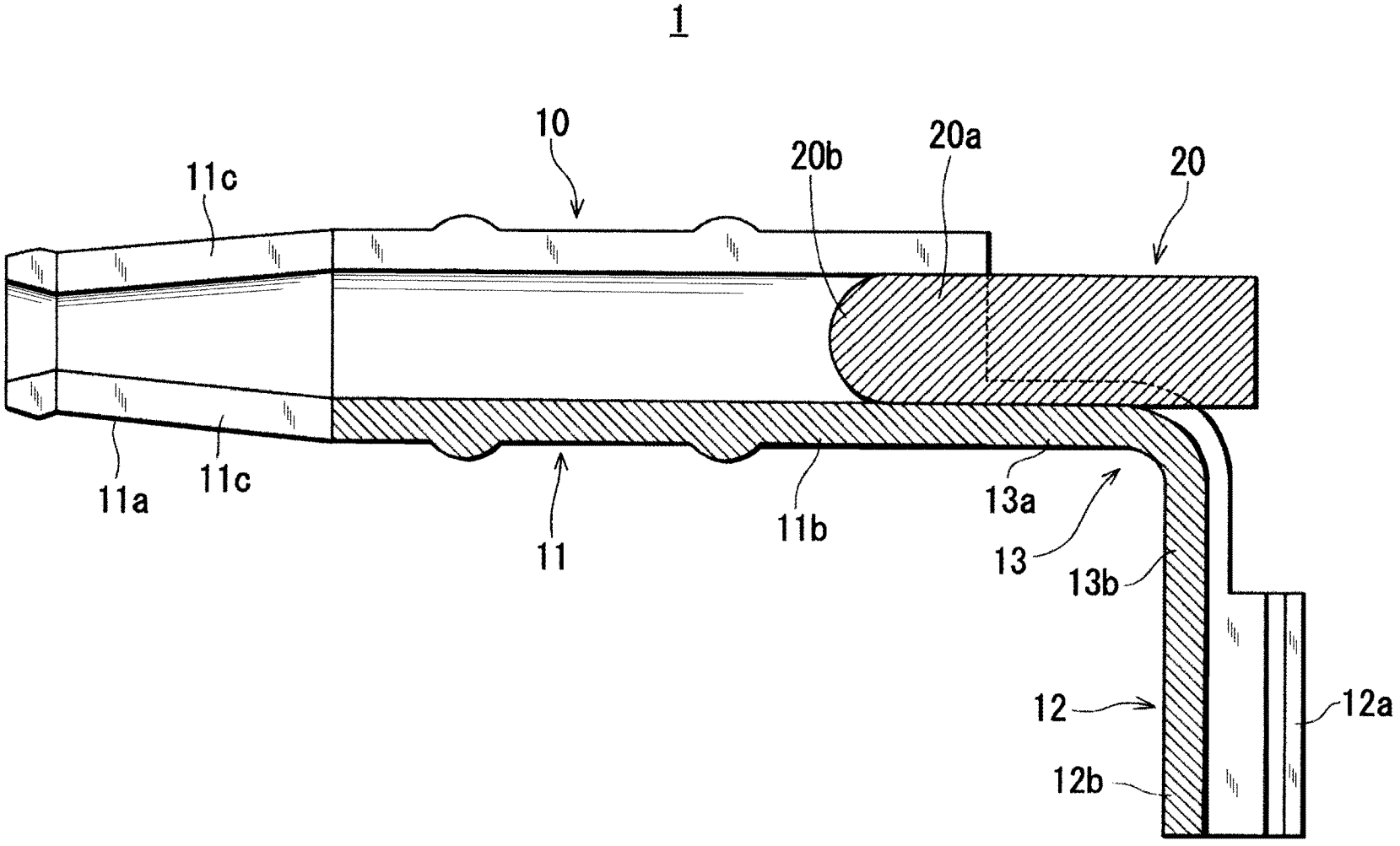
FIG. 3 is a sectional view showing the connector terminal of the embodiment of the invention.

A connector terminal 1 shown in FIGS. 1 to 3 comprises a terminal body 10 and an impedance adjusting member 20.

The terminal body 10 has: in one side, a tubular (female) body portion 11 which functions as the first connecting portion that is tubular, and which is to be connected to a pin-like (male) counter connector terminal that is not shown; and, in the other side, a crimp portion 12 which functions as the second connecting portion, and which is to be connected to a cable conductor that is not shown. The terminal body 10 further has a coupling portion 13 that couples between the body portion 11 and the crimp portion 12. The terminal body 10 is formed by pressing an electrically conductive metal thin plate.

The body portion 11 has a tip end portion 11*a* and a basal portion 11*b*. In the tip end portion 11*a*, a plurality (two in the figures) of slits 11*c* which extend in the axial direction are disposed at regular intervals in the circumferential direction, and the connection with the counter connector terminal is performed by using the slits 11*c*. The basal portion 11*b* which is continuous to the tip end portion 11*a* is formed into a cylindrical shape.

The crimp portion 12 which has not yet been connected to the cable conductor is formed to have a U-like sectional shape, and has: a pair of crimp pieces 12*a* which form the opposed lateral sides of the U-like shape, respectively; and a basal portion 12*b* which forms the bottom side of the U-like shape. The crimp portion 12 can be connected to the cable conductor by, as illustrated, crimping the pair of crimp pieces 12*a* in the state where the cable conductor is fitted.

The coupling portion 13 is configured by a strip-like piece which is thinner than the outer diameter of the basal portion 11*b* of the body portion 11, and which is bent into an L-like shape, has first and second side parts 13*a*, 13*b* which form sides of the L-like shape, respectively, is connected to an end (end face) of the basal portion 11*b* of the body portion 11 in an end (end face) of the first side part 13*a*, and connected to an end (end face) of the basal portion 12*b* of the crimp portion 12 in an end (end face) of the second side part 13*b*.

The impedance adjusting member 20 is a metal member having a round bar-like shape which is longer than the first side part 13*a* of the coupling portion 13 of the terminal body 10, and which is thicker than the inner diameter of the basal portion 11*b* of the body portion 11 of the terminal body 10. The impedance adjusting member 20 is electrically conductive. A tapered tip end 20*b* which is semi-spherical is formed in one end portion 20*a* of the impedance adjusting member 20.

Then, the impedance adjusting member 20 is fixed to the basal portion 11*b* of the body portion 11 of the terminal body 10 in a state where the one end portion 20*a* in which the tapered tip end 20*b* is formed is inserted into the basal portion 11*b* of the body portion 11 of the terminal body 10 through an end opening of the basal portion 11*b*, and the part other than the one end portion 20*a* in which the tapered tip end 20*b* is formed overlaps the first side part 13*a* of the coupling portion 13 of the terminal body 10. In this state, the impedance adjusting member 20 is electrically connected to the terminal body 10. Here, the one end portion 20*a* in which the tapered tip end 20*b* of the impedance adjusting member 20 is formed is thicker than the inner diameter of the basal portion 11*b* of the body portion 11 of the terminal body 10, and configured as a press-fitting part with respect to the basal portion 11*b* of the body portion 11 of the terminal body 10.

Next, the function of the thus configured connector terminal 1 will be described.

In the terminal body 10, the cross-sectional outer shape of the body portion 11 and that of the crimp portion 12 are substantially identical in size with each other, and therefore the impedance of the body portion 11 is approximately equal to that of the crimp portion 12. By contrast, the cross-sectional outer shape of the coupling portion 13 is smaller than both the cross-sectional outer shapes of the body portion 11 and the crimp portion 12, and therefore the impedance of the coupling portion 13 is higher than both the impedances of the body portion 11 and the crimp portion 12. As a result, impedance mismatching is caused between the body portion 11 and the coupling portion 13 and also between the crimp portion 12 and the coupling portion 13.

In the impedance adjusting member 20, the part other than the one end portion 20*a* overlaps the first side part 13*a* of the coupling portion 13 of the terminal body 10. In the part other than the one end portion 20*a*, the cross-sectional outer shape of the first side part 13*a* of the coupling portion 13 of the terminal body 10 is increased, and the impedance of the coupling portion 13 of the terminal body 10 can be lowered. Therefore, the impedance mismatching between the body portion 11 of the terminal body 10 and the coupling portion 13 can be reduced, and impedance matching between the body portion 11 of the terminal body 10 and the coupling portion 13 can be attained.

In this case, the impedance adjusting member 20 is fixed to the basal portion 11*b* of the body portion 11 of the terminal body 10 in the state where the one end portion 20*a* of the impedance adjusting member is inserted into the basal portion 11*b* of the body portion 11 of the terminal body 10 through the end opening of the basal portion 11*b*, whereby the part other than the one end portion 20*a* is caused to overlap the first side part 13*a* of the coupling portion 13 of the terminal body 10. Therefore, impedance matching can be provided between the body portion 11 of the terminal body 10 and the coupling portion 13, simply by inserting the one end portion 20*a* of the impedance adjusting member 20 into the basal portion 11*b* of the body portion 11 of the terminal body 10 through the end opening of the basal portion 11*b*, and it is not necessary to couple the impedance adjusting member 20 to the crimp portion 12 of the terminal body 10. Consequently, the trouble of providing impedance matching between the body portion 11 of the terminal body 10 and the coupling portion 13 can be reduced.

Moreover, the coupling portion 13 of the terminal body 10 is bent into an L-like shape, and therefore the crimp portion 12 does not interfere with the insertion of the one end portion 20*a* of the impedance adjusting member 20 into the basal portion 11*b* of the body portion 11 of the terminal body 10 through the end opening of the basal portion 11*b*, and the insertion can be easily performed. Furthermore, the tapered tip end 20*b* is formed in the one end portion 20*a* of the impedance adjusting member 20. When the one end portion 20*a* of the impedance adjusting member 20 is to be inserted into the basal portion 11*b* of the body portion 11 of the terminal body 10 through the end opening of the basal portion 11*b*, therefore, the insertion can be easily performed.

Moreover, the one end portion 20*a* of the impedance adjusting member 20 is thicker than the inner diameter of the basal portion 11*b* of the body portion 11 of the terminal body 10, and configured as the press-fitting part with respect to the basal portion 11*b* of the body portion 11 of the terminal body 10. Therefore, the one end portion 20*a* can be press-fitted into the basal portion 11*b* of the body portion 11 of the terminal body 10.

In the impedance adjusting member 20, impedance matching between the body portion 11 of the terminal body 10 and the coupling portion 13 can be provided, and at the same time also that between the crimp portion 12 of the terminal body 10 and the coupling portion 13 can be provided.

Embodiment 2

Figure 4:
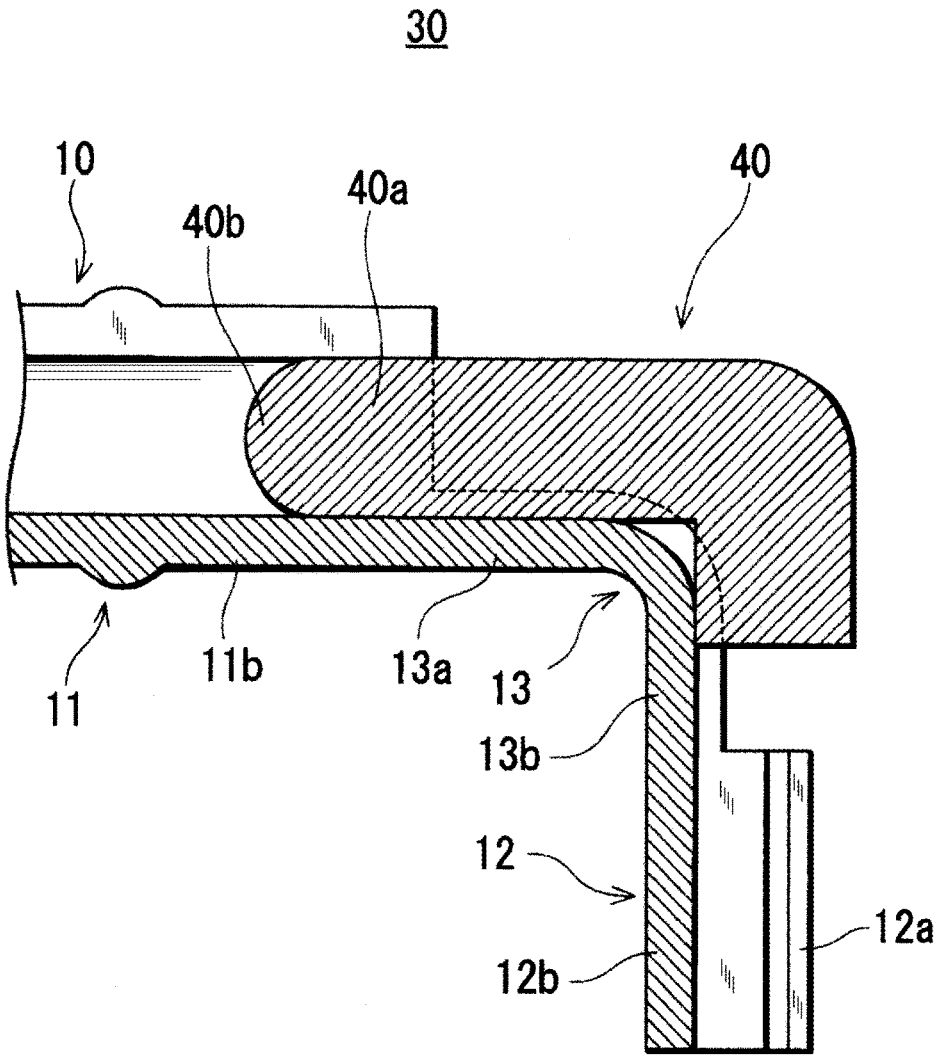
FIG. 4 is a sectional view of main components of a connector terminal of another embodiment of the invention.

A connector terminal 30 shown in FIG. 4 is different from the connector terminal 1 in that the connector terminal 30 comprises an impedance adjusting member 40 which is bent into an L-like shape, in place of the impedance adjusting member 20.

The impedance adjusting member 40 which is bent into an L-like shape is different from the impedance adjusting member 20 in that a part other than one end portion 40*a* in which a tapered tip end 40*b* is formed overlaps the first and second side parts 13*a*, 13*b* of the coupling portion 13 of the terminal body 10.

The impedance adjusting member 40 which is bent into an L-like shape is fixed to the basal portion 11*b* of the body portion 11 of the terminal body 10 in the state where the one end portion 40*a* of the impedance adjusting member is inserted into the basal portion 11*b* of the body portion 11 of the terminal body 10 through the end opening of the basal portion 11*b*, whereby the part other than the one end portion 40*a* is caused to overlap the first and second side parts 13*a*, 13*b* of the coupling portion 13 of the terminal body 10. The impedance of the coupling portion 13 of the terminal body 10 can be lowered by increasing the cross-sectional outer shapes of the first and second side parts 13*a*, 13*b* of the coupling portion 13 of the terminal body 10 in the part other than the one end portion 40*a*. The impedance mismatching between the body portion 11 of the terminal body 10 and the coupling portion 13 can be substantially resolved, and impedance matching between the body portion 11 of the terminal body 10 and the coupling portion 13, and that between the crimp portion 12 of the terminal body 10 and the coupling portion 13 can be attained.

Embodiment 3

Figure 5A:
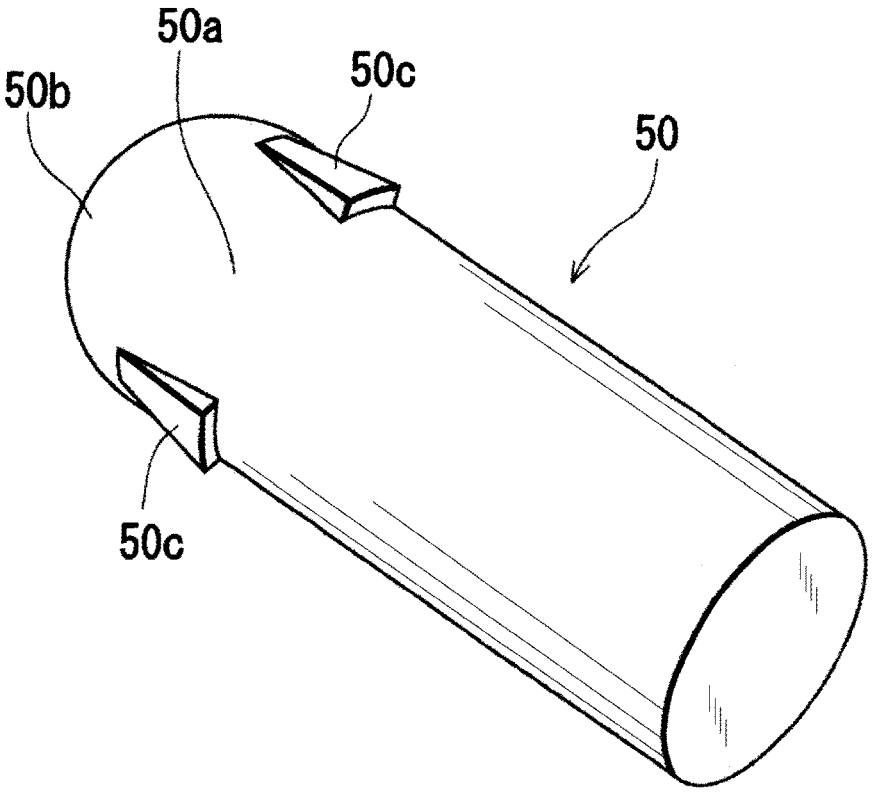
FIG. 5A is a perspective view showing an impedance adjusting member of a connector terminal of a further embodiment of the invention.
Figure 5B:
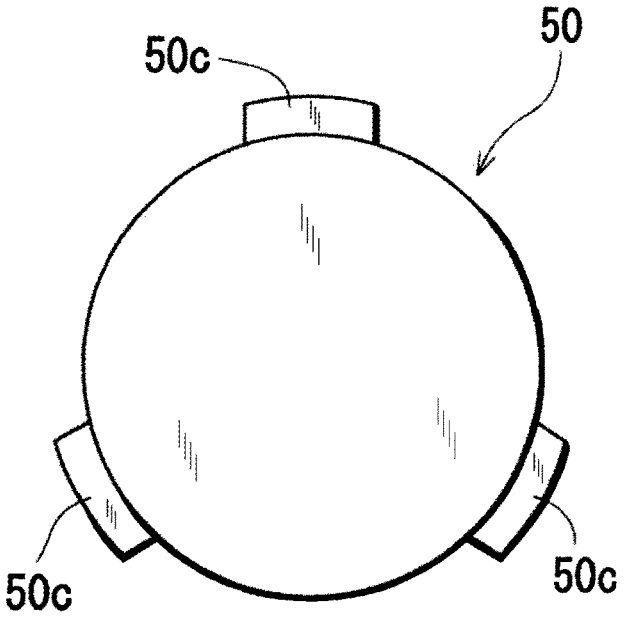
FIG. 5B is a back view of the member.

An impedance adjusting member 50 having wedges shown in FIGS. 5A and 5B is different from the impedance adjusting member 20 in that the impedance adjusting member 50 has a round bar-like shape in which the diameter is approximately equal to the inner diameter of the basal portion 11*b* of the body portion 11 of the terminal body 10, three wedges 50*c* are disposed at regular intervals on the outer circumferential surface of one end portion 50*a* in which a tapered tip end 50*b* is formed, and the outer diameter of the one end portion 50*a* in which a tapered tip end 50*b* is formed is gradually increased by the wedges 50*c* as advancing toward the side opposite to the side of the tip end 50*b*.

Then, the impedance adjusting member 50 having the wedges is fixed to the basal portion 11*b* of the body portion 11 of the terminal body 10 in the state where the one end portion 50*a* in which the tapered tip end 50*b* is formed, and in which the wedges 50*c* are disposed on the outer circumferential surface is press-fitted into the basal portion 11*b* of the body portion 11 of the terminal body 10 through the end opening of the basal portion 11*b*, whereby the part other than the one end portion 50*a* is caused to overlap the first side part 13*a* of the coupling portion 13 of the terminal body 10. The impedance matching between the body portion 11 of the terminal body 10 and the coupling portion 13 can be attained.

Although several embodiments of the invention have been described with reference to the drawings, the invention is not limited to the embodiments, and may be variously modified without departing the spirit of the invention. Although a round bar-like member having a circular section has been used as the impedance adjusting member, for example, the impedance adjusting member may be a polygonal bar having a polygonal section. As the method of fixing the impedance adjusting member in the state where the one end portion is inserted into the basal portion of the body portion of the terminal body, press-fitting has been employed. Alternatively, other engaging means may be employed such as those in which one of a pair of engaging concave and convex parts that are engageable with each other when the impedance adjusting member (shaft) is inserted into the body portion (hole) of the terminal body is disposed in the impedance adjusting member, and the other part is disposed in the basal portion of the body portion of the terminal body.

DESCRIPTION OF REFERENCE NUMERALS

1 connector terminal
10 terminal body
20 impedance adjusting member
20*a* one end portion
20*b* tip end
11 body portion (first connecting portion)
12 crimp portion (second connecting portion)
13 coupling portion
13*a* first side part
13*b* second side part

What is claimed is:

1. A connector terminal which has a first connecting portion that is tubular, in one side, and a second connecting portion in another side, and which further has a coupling portion that couples between the first and second connecting portions, and that is higher in impedance than the first connecting portion, wherein the connector terminal comprises an impedance adjusting member which overlaps at least a part of the coupling portion, and the impedance adjusting member is fixed in a state where one end portion of the impedance adjusting member is inserted into the first connecting portion.

2. The connector terminal according to claim 1, wherein the coupling portion is configured by a strip-like piece which is bent into an L-like shape, has first and second side parts which form sides of the L-like shape, respectively, is connected to the first connecting portion in an end of the first side part, and connected to the second connecting portion in an end of the second side part, and the impedance adjusting member overlaps at least the first side part.

3. The connector terminal according to claim 1, wherein a tapered tip end is formed in the one end portion of the impedance adjusting member.

4. The connector terminal according to claim 1, wherein the one end portion of the impedance adjusting member is thicker than an inner diameter of the first connecting portion, thereby forming the one end portion as a press-fitting part which is inserted into the first connecting portion.

5. The connector terminal according to claim 1, wherein the coupling portion is configured by a strip-like piece which is bent into an L-like shape, has first and second side parts which form sides of the L-like shape, respectively, is connected to the first connecting portion in an end of the first side part, and connected to the second connecting portion in an end of the second side part, the impedance adjusting member overlaps at least the first side part, and a tapered tip end is formed in the one end portion of the impedance adjusting member.

6. The connector terminal according to claim 1, wherein the coupling portion is configured by a strip-like piece which is bent into an L-like shape, has first and second side parts which form sides of the L-like shape, respectively, is connected to the first connecting portion in an end of the first side part, and connected to the second connecting portion in an end of the second side part, the impedance adjusting member overlaps at least the first side part, and the one end portion of the impedance adjusting member is thicker than an inner diameter of the first connecting portion, thereby forming the one end portion as a press-fitting part which is inserted into the first connecting portion.

7. The connector terminal according to claim 1, wherein the coupling portion is configured by a strip-like piece which is bent into an L-like shape, has first and second side parts which form sides of the L-like shape, respectively, is connected to the first connecting portion in an end of the first side part, and connected to the second connecting portion in an end of the second side part, the impedance adjusting member overlaps at least the first side part, a tapered tip end is formed in the one end portion of the impedance adjusting member, and the one end portion of the impedance adjusting member is thicker than an inner diameter of the first connecting portion, thereby forming the one end portion as a press-fitting part which is inserted into the first connecting portion.

* * * * *